US008543030B2

(12) United States Patent
Dobbertin et al.

(10) Patent No.: US 8,543,030 B2
(45) Date of Patent: Sep. 24, 2013

(54) ELECTROPHOTOGRAPHIC PRINTER WITH DUST SEAL

(75) Inventors: Michael Thomas Dobbertin, Honeoye, NY (US); James N. Alkins, Holley, NY (US); Richard G. Luther, Hamlin, NY (US); Jean Marie Trost, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 277 days.

(21) Appl. No.: 13/096,315

(22) Filed: Apr. 28, 2011

(65) Prior Publication Data

US 2012/0207509 A1 Aug. 16, 2012

Related U.S. Application Data

(60) Provisional application No. 61/442,448, filed on Feb. 14, 2011.

(51) Int. Cl.
*G03G 15/08* (2006.01)

(52) U.S. Cl.
USPC ..... 399/103; 399/105; 399/106

(58) Field of Classification Search
USPC ..... 399/102–103, 105
See application file for complete search history.

(56) References Cited

U.S. PATENT DOCUMENTS

| | | | | |
|---|---|---|---|---|
| 4,792,831 | A * | 12/1988 | Takeda et al. | 399/105 |
| 5,044,313 | A * | 9/1991 | Yuge et al. | 399/103 |
| 5,467,174 | A | 11/1995 | Koga | |
| 5,991,568 | A | 11/1999 | Ziegelmuller | |
| 6,385,236 | B1 | 5/2002 | Chen | |
| 6,608,641 | B1 | 8/2003 | Alexandrovich et al. | |
| 6,993,281 | B2 * | 1/2006 | Yoshizawa et al. | 399/349 |
| 7,120,379 | B2 | 10/2006 | Eck | |
| 2002/0168200 | A1 | 11/2002 | Stelter et al. | |
| 2006/0133870 | A1 | 6/2006 | Ng et al. | |
| 2007/0116491 | A1 * | 5/2007 | Park et al. | 399/102 |
| 2008/0013982 | A1 * | 1/2008 | Kimura | 399/103 |
| 2010/0028045 | A1 | 2/2010 | Kawakami et al. | |

FOREIGN PATENT DOCUMENTS

| | | |
|---|---|---|
| GB | 2098095 | 11/1982 |
| GB | 2098096 | 11/1982 |

* cited by examiner

*Primary Examiner* — David Gray
*Assistant Examiner* — Geoffrey Evans
(74) *Attorney, Agent, or Firm* — Christopher J. White; Raymond L. Owens

(57) ABSTRACT

An electrophotographic printer includes a rotatable photoreceptor adapted to receive dry toner and a rotatable toning member arranged with respect to the photoreceptor to supply toner thereto. A seal includes a complaint contact member and a non-contact member. The contact member is arranged in mechanical contact with the photoreceptor. The non-contact member is spaced apart from the surface of the toning member by a selected non-zero distance, the selected distance being greater than zero. This reduces dusting.

13 Claims, 5 Drawing Sheets

ELECTROPHOTOGRAPHIC PRINTER WITH DUST SEAL

CROSS REFERENCE TO RELATED APPLICATIONS

This application claims the priority of U.S. Provisional Application No. 61/442,448, filed Feb. 14, 2011, the disclosure of which is incorporated herein by reference.

FIELD OF THE INVENTION

This invention pertains to the field of electrophotographic printing and more particularly to controlling dusting of particles in a printer.

BACKGROUND OF THE INVENTION

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, charged toner particles are brought into the vicinity of the photoreceptor and are attracted to the latent image to develop the latent image into a visible image. Note that the visible image may not be visible to the naked eye depending on the composition of the toner particles (e.g., clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g., of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

In most electrophotographic development systems, more toner is supplied to the photoreceptor than is necessary to develop the visible image. This provides improved reproduction of large areas of high density on the print. Some of the excess toner can leave the confines of the development station. This toner can contaminate other areas of the imaging module, reducing image quality and printer reliability. Toner can leave the development station through the leading edge, where the charged, un-toned photoreceptor enters the station, or through the trailing edge, where the visible image on the photoreceptor is exiting the development station. Various attempts have been made to reduce contamination. "Contamination" and "dusting" are used synonymously herein, and both refer to airborne particles, e.g., toner particles, being deposited on components of the printer on which they are not intended to be deposited. Dusting in a two-component developer can also occur when toner particles are not sufficiently tribocharged before being agitated. Since the toner particles are not electrostatically attracted to the carrier particles, the toner particles can become airborne more easily than they would if they carried more charge.

For example, seals have been employed on the development station. These can include flaps, plushes, or brushes that make direct contact with the surface of the photoconductor. Seals are generally located on the leading edge of the development station, before development occurs, since the nap created by the developer can seal the trailing edge. Elastomeric seals can be formed from, e.g., polyethylene terephthalate (PET), polyurethane (PUR), polyphenylether (PPE), polycarbonate (PC), polyethylene (PE), polyolefin, and polypropylene (PP). Seals can also be formed from foams, fabrics, rigid plastics, or metals. However, more rigid seal materials increase the risk of damage to the roller in contact with the seal.

U.S. Pat. No. 5,467,174 to Koga, column 6, describes a sealing member provided at the opening of a development unit and in light contact therewith. However, a light seal can be bypassed by sufficiently small particles. Moreover, a light seal only restricts the travel of particles in one direction.

Commonly-assigned U.S. Pat. No. 5,991,568 to Ziegelmuller et al., the disclosure of which is incorporated herein by reference, describes reducing the amount of toner escaping from a cleaning housing. Ziegelmuller describes a dust seal blade that creates a cavity in front of the cleaning blade to capture airborne toner dust, thereby reducing contamination of a cleaning blade engaged with the surface to be cleaned. Ziegelmuller also describes foam and brush seals and upstream sealing blades.

U.S. Publication No. 2010/0028045 to Kawakami et al. describes a cleaning device for a rotary member. The cleaning device includes a seal and a blade pressed against the rotary member and seal extending along the length of the rotary member. The gaps between the seal and the blade at each end of the rotary member are sealed by pressing respective end seals against the rotary member. However, the mechanical contact between the end seal and the rotary member can wear or damage the rotary member. Kawakami suggests that a very limited range of materials (foams, fabrics) can be used to reduce these risks; these limits reduce opportunities to combine part functions and can therefore lead to increased size, weight, and cost of a printer.

Although these devices provide a seal and reduce the loss of toner dust from the development station, mechanical-contact seals can collect material between the seal and the photoconductor, which can in turn scratch the surface of the photoconductor, reducing image quality. Various alternative seal techniques have been tried.

GB 2 098 095 A to Kopp et al. describes a toner dust sealing plate extending close to the photoconductor at the trailing edge of the development station and a vacuum system to reduce dusting out of the leading edge of the development station. Vacuum systems can be noisy and expensive. Moreover, vacuum systems need to be carefully tuned to avoid sucking toner out of the development station.

GB 2 098 096 A to Maier et al. describes a guide means that divides the development station into upper and lower parts. Toner flows from the upper to the lower part around both ends of the guide means, so dust generated in the lower part cannot escape to the upper part. This scheme requires a more complicated development station and can limit the functions that can be performed by or in the development station.

Commonly-assigned U.S. Pat. No. 6,385,236 to Hilbert et al., the disclosure of which is incorporated herein by reference, describes compliant lip seals around roller axles and permanent magnets used as magnetic seals to prevent leakage of developer material from the ends of the development roller. Although useful, this requires magnets; less-expensive seal materials are desirable. Magnetic seals form a "brush" with the magnetic material (e.g. developer) that contacts the moving member and can cause wear or damage to the member.

There is a continuing need, therefore, for an improved seal that reduces dusting in an electrophotographic printer without damaging the photoreceptor.

SUMMARY OF THE INVENTION

According to the present invention, there is provided an electrophotographic printer adapted to reduce dusting, comprising:

a. a rotatable photoreceptor adapted to receive dry toner;

b. a rotatable toning member arranged with respect to the photoreceptor to supply toner thereto; and c. a seal including a compliant contact member and a non-contact member, the contact member arranged in mechanical contact with the photoreceptor and the non-contact member spaced apart from the surface of the toning member by a selected distance, the selected distance being greater than zero.

An advantage of this invention is that it reduces dusting by reducing or diverting airflow resulting from the motion of the developer nap on the toning member. In various embodiments, the non-contact member is set at the nap height so that substantially no air flows past the non-contact member in the direction of rotation of the toning member. As a result, dust carried in the air stream ahead of the non-contact member is retained behind the non-contact member, or is forced back into the developer nap. Less dust therefore reaches the air stream around the rotating photoreceptor. As a result, less dust travels around the photoreceptor and is deposited on the back side of the contact member or other components adjacent to the photoreceptor. Toner and carrier particles in dust held behind the non-contact member can tribocharge as they are agitated by the air behind the non-contact member, pulling them into the developer nap and further reducing dusting. Carrier particles are much less likely to become lodged in or affixed to the compliant contact member than they are in or to a plush, foam seal, or other member with numerous voids in which particles can lodge. In various embodiments, the contact member exerts less frictional force on the photoreceptor than a plush or foam seal, reducing the torque required to drive the photoreceptor at a given speed, and thus reducing the energy required to operate the printer.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
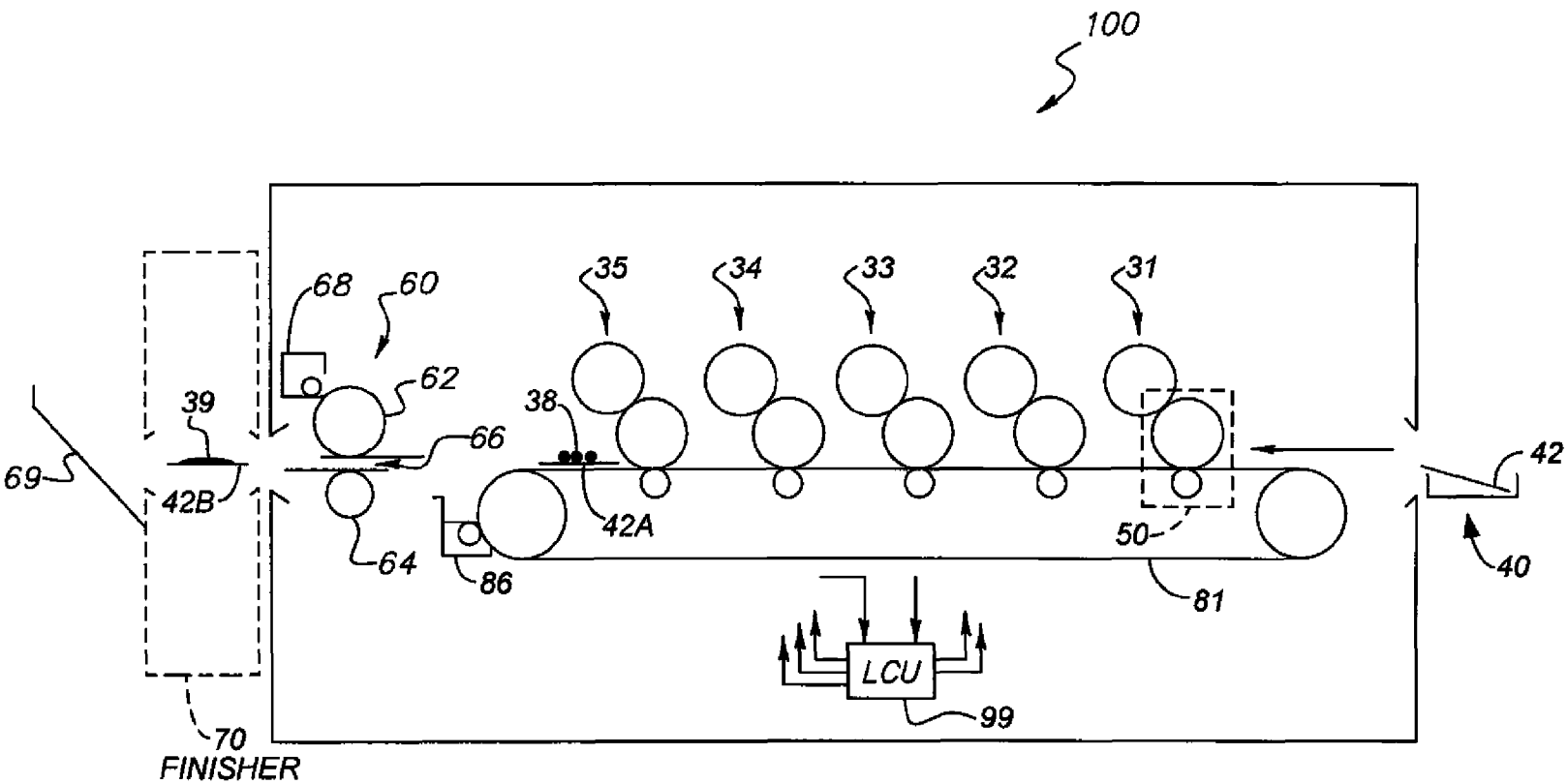
FIG. 1 is an elevational cross-section of an electrophotographic reproduction apparatus suitable for use with various embodiments.

The attached drawings are for purposes of illustration and are not necessarily to scale.

DETAILED DESCRIPTION OF THE INVENTION

As used herein, the terms "parallel" and "perpendicular" have a tolerance of ±10°.

As used herein, "toner particles" are particles of one or more material(s) that are transferred by an electrophotographic (EP) printer to a receiver to produce a desired effect or structure (e.g., a print image, texture, pattern, or coating) on the receiver. Toner particles can be ground from larger solids, or chemically prepared (e.g., precipitated from a solution of a pigment and a dispersant using an organic solvent), as is known in the art. Toner particles can have a range of diameters, e.g., less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles, and that can form an image, pattern, or coating when deposited on an imaging member including a photoreceptor, a photoconductor, or an electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g., particles containing colorants such as dyes or pigments), absorption of moisture or gasses (e.g., desiccants or getters), suppression of bacterial growth (e.g., biocides, particularly useful in liquid-toner systems), adhesion to the receiver (e.g., binders), electrical conductivity or low magnetic reluctance (e.g., metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture including toner particles and magnetic carrier particles, which can be electrically-conductive or -non-conductive. Toner particles can be magnetic or non-magnetic. The carrier particles can be larger than the toner particles, e.g., 15-20 μm or 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various embodiments described herein are useful with electrostatographic printers such as electrophotographic printers that employ toner developed on an electrophotographic receiver, and sonographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g., a UV coating system, a glosser system, or a laminator system). A printer can reproduce pleasing black-and-white or color onto a receiver. A printer can also produce selected patterns of toner on a receiver, which patterns (e.g., surface textures) do not correspond directly to a visible image. The DFE receives input electronic files (such as Postscript command files) composed of images from other input devices (e.g., a scanner, a digital camera). The DFE can include various function processors, e.g., a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g., the electrophotographic process) to provide known, consistent color reproduction characteristics. The color management system can also provide known color reproduction for different inputs (e.g., digital camera images or film images).

In an embodiment of an electrophotographic modular printing machine useful with various embodiments, e.g., the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g., dyes or pigments, which absorb specific wavelengths of visible light. Commercial machines of this type typically employ intermediate transfer members in the respective modules for transferring visible images from the photoreceptor and transferring print images to the receiver. In other electrophotographic printers, each visible image is directly transferred to a receiver to form the corresponding print image.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g., dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

Figure 2:
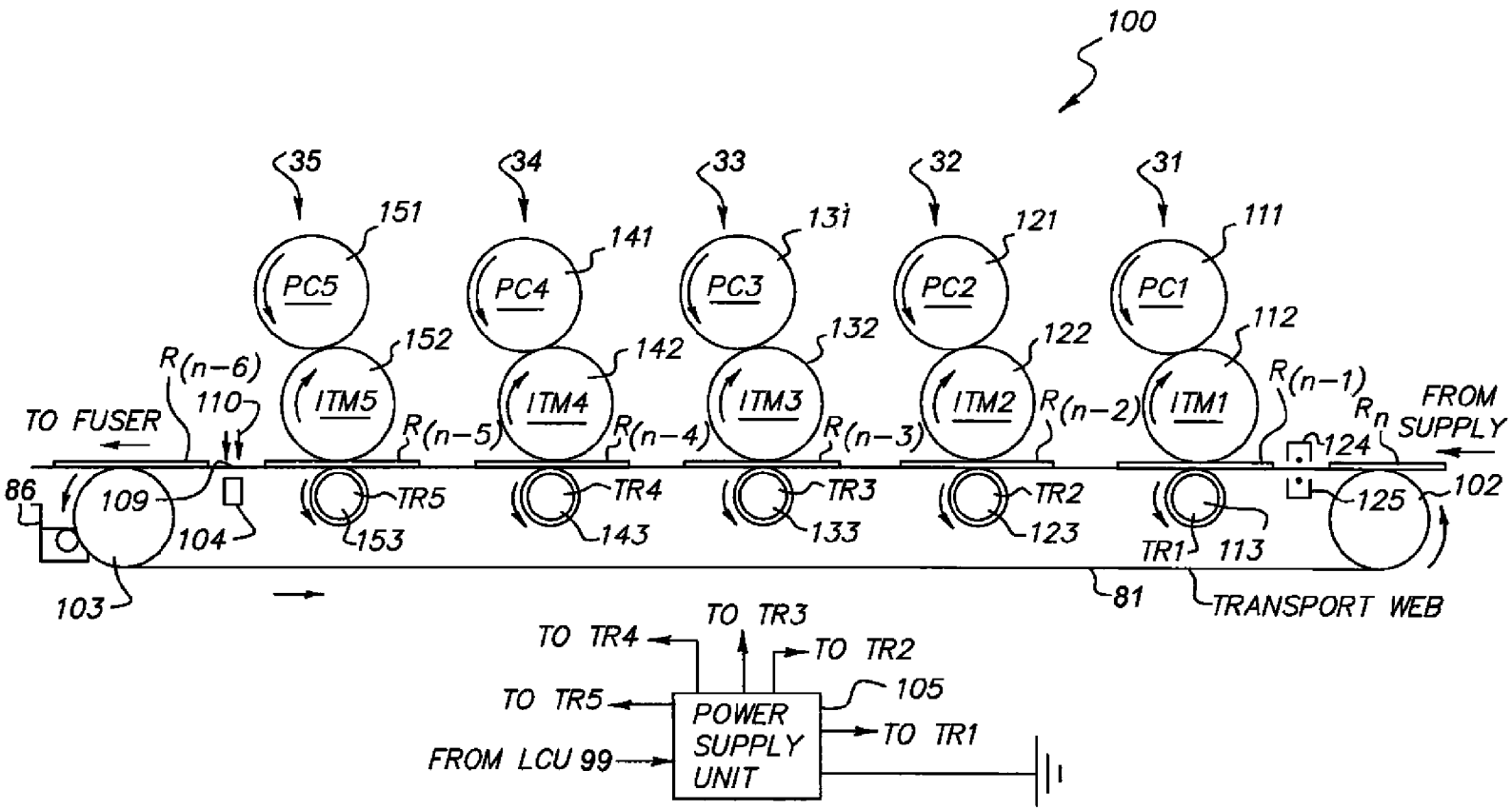
FIG. 2 is an elevational cross-section of the reprographic image-producing portion of the apparatus of FIG. 1.
Figure 3:
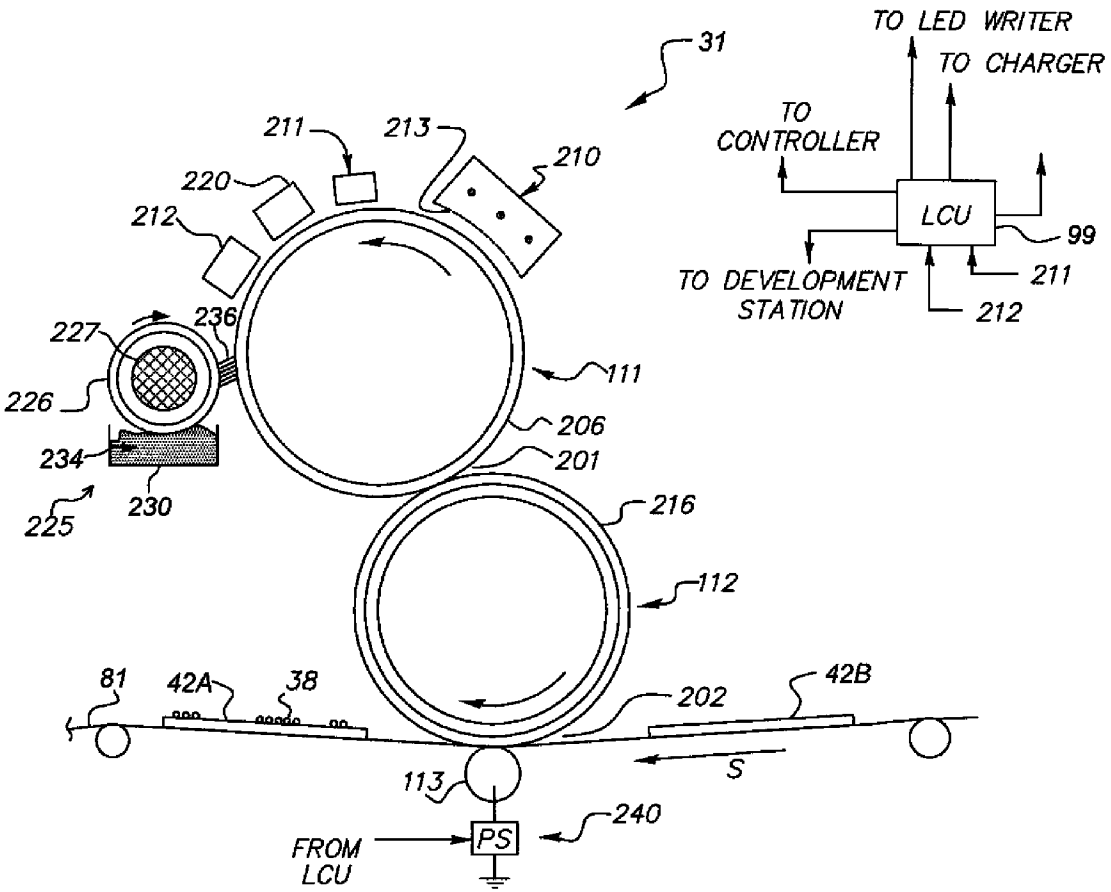
FIG. 3 is an elevational cross-section of one printing module of the apparatus of FIG. 1.

FIGS. 1-3 are elevational cross-sections showing portions of a typical electrophotographic printer 100 useful with various embodiments. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to receiver 42. Receiver 42 is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g., metallic, fluorescent, or pearlescent colors), or a clear toner or tinted toner. Tinted toners absorb less light than they transmit, but do contain pigments or dyes that move the hue of light passing through them towards the hue of the tint. For example, a blue-tinted toner coated on white paper will cause the white paper to appear light blue when viewed under white light, and will cause yellows printed under the blue-tinted toner to appear slightly greenish under white light.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, receiver 42A is advanced to a fuser 60, i.e. a fusing or fixing assembly, to fuse print image 38 to receiver 42A. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81. A mechanical cleaning station (not shown) for scraping or vacuuming toner off transport web 81 can also be used independently or with cleaning station 86. The mechanical cleaning station can be disposed along transport web 81 before or after cleaning station 86 in the direction of rotation of transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g., silicone oil, to fusing roller 62. Alternatively, wax-containing toner can be used without applying release fluid to fusing roller 62. Other embodiments of fusers, both contact and non-contact, can be employed. For example, solvent fixing uses solvents to soften the toner particles so they bond with the receiver. Photoflash fusing uses short bursts of high-frequency electromagnetic radiation (e.g., ultraviolet light) to melt the toner. Radiant fixing uses lower-frequency electromagnetic radiation (e.g., infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g., receiver 42B) carrying the fused image (e.g., fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), programmable logic controller (PLC) (with a program in, e.g., ladder logic), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of the respective LED writers, e.g., for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g., color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, to Peter S. Alexandrovich et al., and in U.S. Publication No. 2006/0133870, published on June 22, 2006, by Yee S. Ng et al., the disclosures of which are incorporated herein by reference.

Referring to FIG. 2, receivers $R_n$-$R_{(n-6)}$ are delivered from supply unit 40 (FIG. 1) and transported through the printing modules 31, 32, 33, 34, 35. The receivers are adhered (e.g., electrostatically using coupled corona tack-down chargers 124, 125) to an endless transport web 81 entrained and driven about rollers 102, 103. Each of the printing modules 31, 32, 33, 34, 35 includes a respective imaging member (111, 121, 131, 141, 151), e.g., a roller or belt, an intermediate transfer member (112, 122, 132, 142, 152), e.g., a blanket roller, and transfer backup member (113, 123, 133, 143, 153), e.g., a roller, belt or rod. Thus in printing module 31, a print image (e.g., a black separation image) is created on imaging member PC1 (111), transferred to intermediate transfer member ITM1 (112), and transferred again to receiver $R_{(n-1)}$ moving through transfer subsystem 50 (FIG. 1) that includes transfer member ITM1 (112) forming a pressure nip with a transfer backup member TR1 (113). Similarly, printing modules 32, 33, 34, and 35 include, respectively: PC2, ITM2, TR2 (121, 122, 123); PC3, ITM3, TR3 (131, 132, 133); PC4, ITM4, TR4 (141, 142, 143); and PC5, ITM5, TR5 (151, 152, 153). The direction of transport of the receivers is the slow-scan direction; the perpendicular direction, parallel to the axes of the intermediate transfer members (112, 122, 132, 142, 152), is the fast-scan direction.

A receiver, $R_n$, arriving from supply unit 40 (FIG. 1), is shown passing over roller 102 for subsequent entry into the transfer subsystem 50 (FIG. 1) of the first printing module, 31, in which the preceding receiver $R_{(n-1)}$ is shown. Similarly, receivers $R_{(n-2)}$, $R_{(n-3)}$, $R_{(n-4)}$, and $R_{(n-5)}$ are shown moving respectively through the transfer subsystems (for clarity, not labeled) of printing modules 32, 33, 34, and 35. An unfused print image formed on receiver $R_{(n-6)}$ is moving as shown towards fuser 60 (FIG. 1).

A power supply 105 provides individual transfer currents to the transfer backup members 113, 123, 133, 143, and 153. LCU 99 (FIG. 1) provides timing and control signals to the components of printer 100 in response to signals from sensors in printer 100 to control the components and process control parameters of the printer 100. A cleaning station 86 for transport web 81 permits continued reuse of transport web 81. A densitometer array includes a transmission densitometer 104 using a light beam 110. The densitometer array measures optical densities of five toner control patches transferred to an interframe area 109 located on transport web 81, such that one or more signals are transmitted from the densitometer array to a computer or other controller (not shown) with corresponding signals sent from the computer to power supply 105. Transmission densitometer 104 is preferably located between printing module 35 and roller 103. Reflection densitometers, and more or fewer test patches, can also be used.

FIG. 3 shows more details of printing module 31, which is representative of printing modules 32, 33, 34, and 35 (FIG. 1). Primary charging subsystem 210 uniformly electrostatically charges photoreceptor 206 of imaging member 111, shown in the form of an imaging cylinder. Charging subsystem 210 includes a grid 213 having a selected voltage. Additional components provided for control can be assembled about the various process elements of the respective printing modules. Meter 211 measures the uniform electrostatic charge provided by charging subsystem 210, and meter 212 measures the post-exposure surface potential within a patch area of a latent image formed from time to time in a non-image area on photoreceptor 206. Other meters and components can be included.

LCU 99 sends control signals to the charging subsystem 210, the exposure subsystem 220 (e.g., laser or LED writers), and the respective development station 225 of each printing module 31, 32, 33, 34, 35 (FIG. 1), among other components. Each printing module can also have its own respective controller (not shown) coupled to LCU 99.

Imaging member 111 includes photoreceptor 206. Photoreceptor 206 includes a photoconductive layer formed on an electrically conductive substrate. The photoconductive layer is an insulator in the substantial absence of light so that electric charges are retained on its surface. Upon exposure to light, the charge is dissipated. In various embodiments, photoreceptor 206 is part of, or disposed over, the surface of imaging member 111, which can be a plate, drum, or belt. Photoreceptors can include a homogeneous layer of a single material such as vitreous selenium or a composite layer containing a photoconductor and another material. Photoreceptors can also contain multiple layers.

An exposure subsystem 220 is provided for image-wise modulating the uniform electrostatic charge on photoreceptor 206 by exposing photoreceptor 206 to electromagnetic radiation to form a latent electrostatic image (e.g., of a separation corresponding to the color of toner deposited at this printing module). The uniformly-charged photoreceptor 206 is typically exposed to actinic radiation provided by selectively activating particular light sources in an LED array or a laser device outputting light directed at photoreceptor 206. In embodiments using laser devices, a rotating polygon (not shown) is used to scan one or more laser beam(s) across the photoreceptor in the fast-scan direction. One dot site is exposed at a time, and the intensity or duty cycle of the laser beam is varied at each dot site. In embodiments using an LED array, the array can include a plurality of LEDs arranged next to each other in a line, all dot sites in one row of dot sites on the photoreceptor can be selectively exposed simultaneously, and the intensity or duty cycle of each LED can be varied within a line exposure time to expose each dot site in the row during that line exposure time.

As used herein, an "engine pixel" is the smallest addressable unit on photoreceptor 206 or receiver 42 (FIG. 1) which the light source (e.g., laser or LED) can expose with a selected exposure different from the exposure of another engine pixel. Engine pixels can overlap, e.g., to increase addressability in the slow-scan direction (S). Each engine pixel has a corresponding engine pixel location, and the exposure applied to the engine pixel location is described by an engine pixel level.

The exposure subsystem 220 can be a write-white or write-black system. In a write-white or charged-area-development (CAD) system, the exposure dissipates charge on areas of photoreceptor 206 to which toner should not adhere. Toner particles are charged to be attracted to the charge remaining on photoreceptor 206. The exposed areas therefore correspond to white areas of a printed page. In a write-black or discharged-area development (DAD) system, the toner is charged to be attracted to a bias voltage applied to photoreceptor 206 and repelled from the charge on photoreceptor 206. Therefore, toner adheres to areas where the charge on photoreceptor 206 has been dissipated by exposure. The exposed areas therefore correspond to black areas of a printed page.

A development station 225 includes toning shell 226, which can be rotating or stationary, for applying toner of a selected color to the latent image on photoreceptor 206 to produce a visible image on photoreceptor 206. Development station 225 is electrically biased by a suitable respective voltage to develop the respective latent image, which voltage can be supplied by a power supply (not shown). Developer is provided to toning shell 226 by a supply system (not shown), e.g., a supply roller, auger, or belt. Toner is transferred by electrostatic forces from development station 225 to photoreceptor 206. These forces can include Coulombic forces between charged toner particles and the charged electrostatic latent image, and Lorentz forces on the charged toner particles due to the electric field produced by the bias voltages.

In an embodiment, development station 225 employs a two-component developer that includes toner particles and magnetic carrier particles. Development station 225 includes a magnetic core 227 to cause the magnetic carrier particles near toning shell 226 to form a "magnetic brush," as known in the electrophotographic art. Magnetic core 227 can be stationary or rotating, and can rotate with a speed and direction the same as or different than the speed and direction of toning shell 226. Magnetic core 227 can be cylindrical or non-cylindrical, and can include a single magnet or a plurality of magnets or magnetic poles disposed around the circumference of magnetic core 227. Alternatively, magnetic core 227 can include an array of solenoids driven to provide a magnetic field of alternating direction. Magnetic core 227 preferably provides a magnetic field of varying magnitude and direction around the outer circumference of toning shell 226. Further details of magnetic core 227 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. Development station 225 can also employ a mono-component developer comprising toner, either magnetic or non-magnetic, without separate magnetic carrier particles.

Toner is transferred from toning shell 226 to photoreceptor 206 in toning zone 236. As described above, toner is selectively supplied to the photoreceptor by toning shell 226. Toning shell 226 receives developer 234 from developer supply 230, which can include a mixer.

Transfer subsystem 50 (FIG. 1) includes transfer backup member 113, and intermediate transfer member 112 for transferring the respective print image from photoreceptor 206 of imaging member 111 through a first transfer nip 201 to surface 216 of intermediate transfer member 112, and thence to a receiver (e.g., 42B) which receives the respective toned print images 38 from each printing module in superposition to form a composite image thereon. Print image 38 is e.g., a separation of one color, such as cyan. Receivers are transported by transport web 81. Transfer to a receiver is effected by an electrical field provided to transfer backup member 113 by power source 240, which is controlled by LCU 99. Receivers can be any objects or surfaces onto which toner can be transferred from imaging member 111 by application of the electric field. In this example, receiver 42B is shown prior to entry into second transfer nip 202, and receiver 42A is shown subsequent to transfer of the print image 38 onto receiver 42A.

Figure 4:
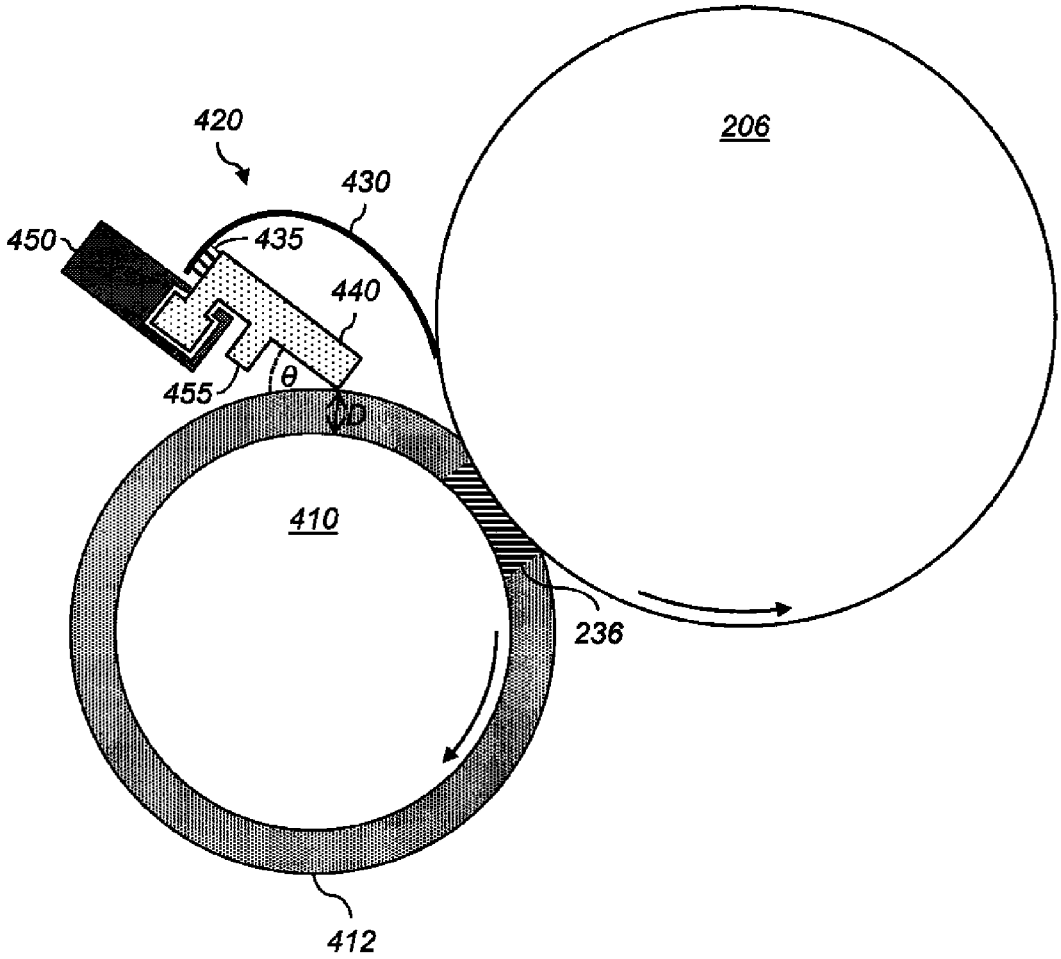
FIGS. 4 and 5 show portions of an electrophotographic (EP) printer according to various embodiments.

FIG. 4 shows portions of an electrophotographic (EP) printer according to various embodiments. The printer includes rotatable photoreceptor 206 (a drum or belt) adapted to receive dry toner in toning zone 236, as discussed above. Rotatable toning member 410 (a drum or belt) is arranged with respect to photoreceptor 206 to supply toner thereto, as discussed above. Toning member 410 can be a shell, a shell with core, or another style of toning member, for either a single-component or multi-component developer.

Seal 420 is provided to reduce toner-dust or developer-dust contamination of surfaces of the printer. Seal 420 includes compliant contact member 430 that is arranged to make mechanical contact with the surface of photoreceptor 206 (or a protective overcoat thereover) at one or more points. Contact member 430 can be a boPET (biaxially-oriented polyethylene terephthalate, e.g., that sold as MYLAR), polyolefin, or polyurethane sheet. Polyolefin can be less susceptible to damage during handling or operation than boPET. Various polyolefins are also less stiff than boPET, so they can be used effectively with softer photoreceptors than can be used effectively with boPET. In an embodiment, a polyolefin with a Shore A durometer of 95 is used. In an embodiment, non-contact member 430 is 0.006" thick. In various embodiments, such as that shown, contact member 430 is bent in the direction of rotation of the photoreceptor. That is, contact member 430 bends with photoreceptor 206 rather than against it. This advantageously reduces the probability of scraping photoreceptor 206 with contact member 430.

Seal 420 also includes non-contact member 440, which can be machined or extruded. Non-contact member 440 can be formed from boPET, polyurethane, polycarbonate, acrylonitrile butadiene styrene (ABS), or acrylic materials. In an embodiment, the non-contact member is rigid. The non-contact member is preferably formed from a material with a low-magnitude temperature coefficient of expansion. In an embodiment, non-contact member 440 has a Young's modulus greater than the Young's modulus of contact member 430. That is, non-contact member 440 is stiffer than contact member 430. In an embodiment, contact member 430 is flexible and non-contact member 440 is rigid.

Non-contact member 440 is spaced apart from the surface of toning member 410 by a selected distance D. Distance D is greater than zero, so there is a gap between the surface of toning member 410 and the closest point on non-contact member 440. Distance D is preferably greater than or equal to the nap height of developer nap 412, the blanket of developer carried with the surface of toning member 410 as toning member 410 rotates. Note that toner is transferred from the nap to the photoreceptor in toning zone 236, as discussed above. In various embodiments, non-contact member 440 is spaced between 0.1 mm and 2.0 mm, or between 1.0 mm and 1.5 mm, from the outer surface of the toning nap on toning member 410. The outer surface can be measured at each point individually or, for drums, characterized as the cylinder of radius equal to the average or maximum nap height with respect to the center of the toning member 410.

In various embodiments, non-contact member 440 is arranged to form an acute angle θ with the surface of toning member 410 as the toning member rotates. This captures dust and can press the dust back into the nap without skiving off dust, toner, or developer.

In various embodiments, contact member 430 is affixed to non-contact member 440 with adhesive 435. Double-sided plastic pressure-sensitive adhesive tape (e.g., SCOTCH brand tape), UV-curable adhesives, contact cement (e.g., cyanoacrylate) can be used. In other embodiments, contact member 430 is clamped, screwed, bolted, nailed, stapled, or otherwise mechanically fastened to non-contact member 440.

In various embodiments, housing 450 holds seal 420 in position with respect to photoreceptor 206 and toning member 410. Housing 450 can be designed with a longitudinal slit to receive seal 420. This permits seal 420 to be readily replaced when desired.

In some of these embodiments, seal 420 includes mechanical key 455 adapted to prevent installation of the seal in other than a selected orientation. In this example, key 455 is a protrusion that interferes with housing 450 if an attempt is made to install seal 420 upside-down.

Contact member 430 exerts a frictional drag force on photoreceptor 206 as photoreceptor 206 rotates. In various embodiments, contact member 430 exerts a drag force of 0.1N-1.0N. By comparison, prior-art plush seals exert drag forces from 1.6N-2.8N.

Although prior-art plushes have a larger area of contact with photoreceptor 206 than contact member 430, the seal provided by the combination of contact member 430 against photoreceptor 206 and non-contact member 440 was determined to be more effective at preventing dust from migrating from the toning station than a tested prior-art plush used in the KODAK NEXPRESS 3600.

The tested plush had a free extension of 6 mm and made contact with an area of photoreceptor 206 extending 6 mm along the surface (around the circumference) of photoreceptor 206. In contrast, the free extension of a tested contact member 430 was in the range of 6-7 mm, and contact member 430 made edge contact with photoreceptor 206. Despite the smaller contact area, the inventive seal was more effective at containing dusting in the toning station than the tested comparative plush.

Figure 5:
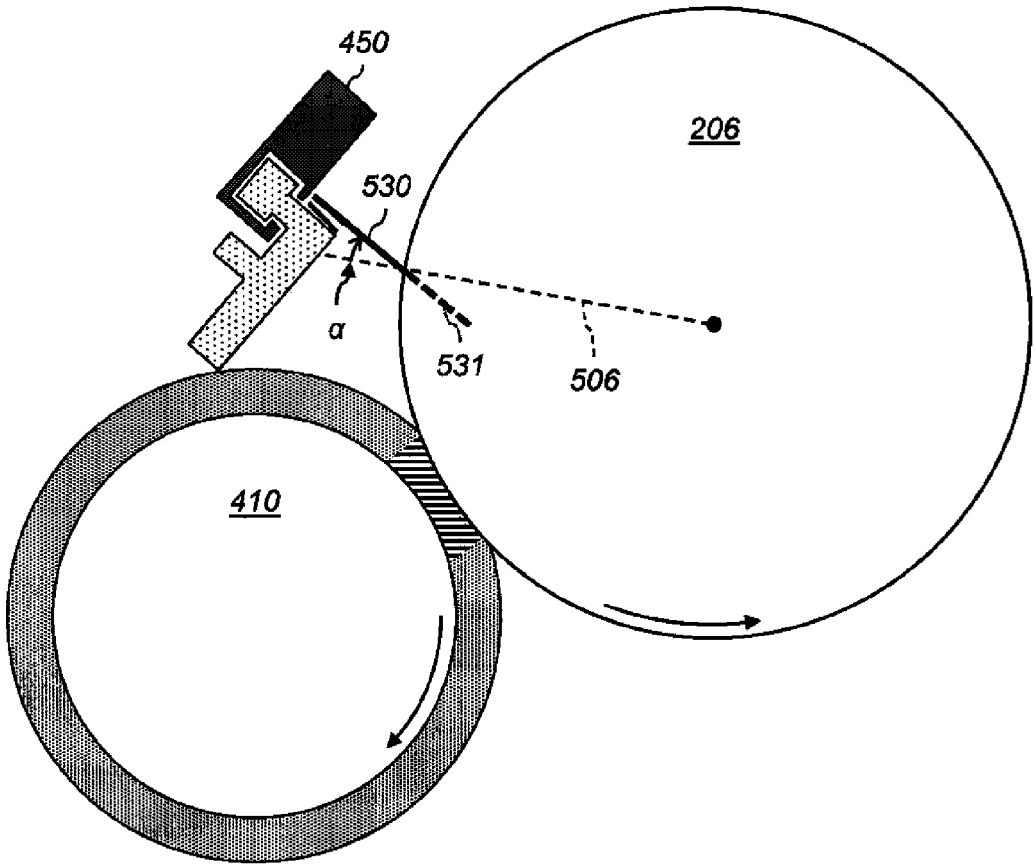

FIG. 5 shows portions of an electrophotographic (EP) printer according to various embodiments. Photoreceptor 206, toning member 410, and housing 450 are as shown in FIG. 4. Contact member 530 is as discussed above, but is shown here in its free (undeformed) state. Interference 531 shows the position of contact member 530 before it engages photoreceptor 206. Normal 506 is the normal to photoreceptor 206 through the intersection between the surface of photoreceptor 206 and the undeformed contact member 503 (and interference 531), as shown. Housing 450 holds contact member 530 angled in the direction of rotation of photoreceptor 206. That is, the angle $\alpha$ from normal 506 to the extension of contact member 530 in its free state points opposite the direction of rotation of photoreceptor 206. As a result, the angle between the extension of contact member 530 in its free state and the tangent to photoreceptor 206 at the point of intersection between the surface of photoreceptor 206 and the extension of contact member 530 in its free state is acute. In an embodiment, a is from 10°-30°, preferably 20°.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
102, 103 roller
104 transmission densitometer
105 power supply
109 interframe area
110 light beam
111, 121, 131, 141, 151 imaging member
112, 122, 132, 142, 152 transfer member
113, 123, 133, 143, 153 transfer backup member
124, 125 corona tack-down chargers
201 transfer nip
202 second transfer nip
206 photoreceptor
210 charging subsystem
211 meter
212 meter
213 grid
216 surface
220 exposure subsystem
225 development subsystem
226 toning shell
227 magnetic core
230 developer supply
234 developer
236 toning zone
240 power source
410 toning member
412 nap
420 seal
430 contact member
435 adhesive
440 non-contact member
450 housing
455 key
506 normal
530 contact member
531 interference
D distance
ITM1-ITM5 intermediate transfer member
PC1-PC5 imaging member
$R_n$-$R_{(n-6)}$ receiver
S slow-scan direction
TR1-TR5 transfer backup member
$\alpha$, $\theta$ angle

The invention claimed is:

1. An electrophotographic printer adapted to reduce dusting, comprising:

a. a rotatable photoreceptor adapted to receive dry toner;

b. a rotatable toning member arranged with respect to the photoreceptor to supply toner thereto; and c. a seal including a compliant contact member and a non-contact member, the contact member arranged in mechanical contact with the photoreceptor and the non-contact member spaced apart from the surface of the toning member by a selected non-zero distance, the selected distance being greater than zero and wherein the contact member exerts a drag force on the photoreceptor of 0.1N-1.0N.

2. The printer according to claim 1, wherein the contact member is affixed to the non-contact member with an adhesive.

3. The printer according to claim 1, further including a housing adapted to hold the seal in position with respect to the photoreceptor and toning member.

4. The printer according to claim 3, wherein the seal further includes a mechanical key adapted to prevent installation of the seal in the housing in other than a selected orientation.

5. The printer according to claim 3, wherein the housing holds the contact member angled in the direction of rotation of the photoreceptor.

6. The printer according to claim 1, wherein the contact member is formed from biaxially-oriented polyethylene terephthalate, polyolefin, or polyurethane.

7. The printer according to claim 1, wherein the non-contact member is formed from biaxially-oriented polyethylene terephthalate, polyurethane, polycarbonate, acrylonitrile butadiene styrene, or acrylic.

8. The printer according to claim 1, wherein the contact member is bent in the direction of rotation of the photoreceptor.

9. The printer according to claim 1, wherein the non-contact member is arranged to form an acute angle with the surface of the toning member as the toning member rotates.

10. The printer according to claim 1, wherein the toning member carries a developer nap as it rotates, and the selected distance is greater than the nap height of the developer nap.

11. The printer according to claim 10, wherein the non-contact member is spaced between 0.1 mm and 2.0 mm from the outer surface of the developer nap.

12. The printer according to claim 10, wherein the non-contact member is spaced between 1 mm and 1.5 mm from the outer surface of the developer nap.

13. The printer according to claim 1, wherein the non-contact member has a Young's modulus greater than the Young's modulus of the contact member.

* * * * *